US006731266B1

(12) United States Patent
Jung

(10) Patent No.: US 6,731,266 B1
(45) Date of Patent: May 4, 2004

(54) DRIVING DEVICE AND DRIVING METHOD FOR A DISPLAY DEVICE

(75) Inventor: Byung-Hoo Jung, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/389,474

(22) Filed: Sep. 3, 1999

(30) Foreign Application Priority Data

Sep. 3, 1998 (KR) ..... 98-36224
Sep. 3, 1998 (KR) ..... 98-36227

(51) Int. Cl.[7] ..... G09G 3/36
(52) U.S. Cl. ..... 345/103; 345/99
(58) Field of Search ..... 345/37, 58, 90, 345/92, 94, 96, 98–100, 211–213, 103

(56) References Cited

U.S. PATENT DOCUMENTS 4,714,921 A 12/1987 Kanno et al. ..... 340/784
5,028,916 A 7/1991 Ichikawa et al. ..... 340/784
5,151,689 A * 9/1992 Kabuto et al. ..... 340/784
5,398,043 A * 3/1995 Takeda et al. ..... 345/94
5,426,447 A * 6/1995 Lee ..... 345/103
5,510,807 A 4/1996 Lee et al. ..... 345/103
5,686,936 A * 11/1997 Maekawa et al. ..... 345/100
5,708,454 A * 1/1998 Katoh et al. ..... 345/100
5,892,493 A * 4/1999 Enami et al. ..... 345/94

FOREIGN PATENT DOCUMENTS

EP 0 755 044 A1 7/1996 ..... G09G/3/36
EP 0 821 490 A1 1/1997 ..... H03M/1/74

* cited by examiner

*Primary Examiner*—Bipin Shalwala
*Assistant Examiner*—Jeff Piziali
(74) *Attorney, Agent, or Firm*—McGuireWoods LLP

(57) ABSTRACT

Disclosed is a display device (e.g., a liquid crystal display), and an apparatus and a method for driving the display device. The LCD includes an LCD panel having a plurality of gate lines, a plurality of data lines insulated from and intersecting the gate lines, and a plurality of TFTs each having a gate electrode connected to one of the gate lines and a source electrode each connected to one of the data lines; a gate driver for sequentially supplying gate drive signals to the gate lines to turn the TFTs ON; and a data driver for dividing the data lines into a certain number of blocks, each block having a predetermined number of data lines, and applying image signals to the data lines in an (n)th block, and applying precharging voltages to the data lines in an (n+j)th block. The apparatus includes the gate driver and the data driver. The method includes the steps of sequentially supplying the gate drive signals to the gate lines to turn the TFTs ON; and applying the image signals to the data lines in an (n)th block, and applying precharging voltages to the data lines in an (n+j)th block.

29 Claims, 12 Drawing Sheets

도 8d
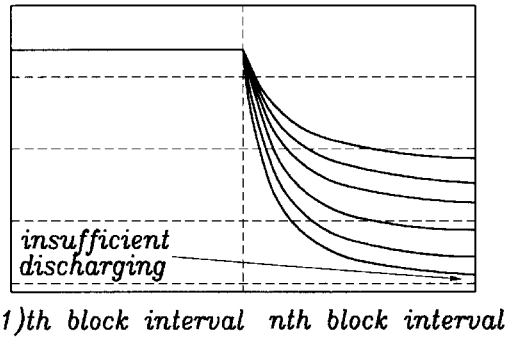
도 8e
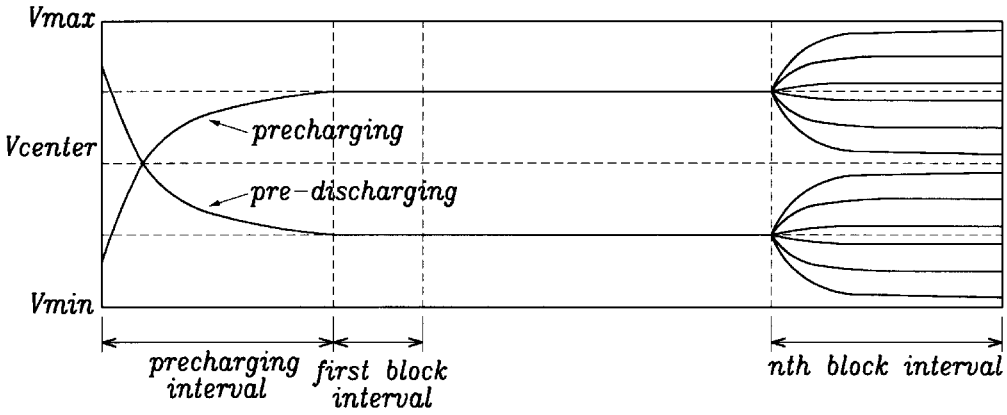

DRIVING DEVICE AND DRIVING METHOD FOR A DISPLAY DEVICE

BACKGROUND OF THE INVENTION (a) Field of the Invention

The present invention relates to a display device, and an apparatus and method for driving the display device. More particularly, the present invention relates to a thin film transistor liquid crystal display (TFT-LCD), and an apparatus and method for driving the TFT-LCD.

(b) Description of the Related Art

TFT-LCDs apply an electric field to liquid crystal material having anisotropic dielectricity and injected between two substrates to form a liquid crystal layer. The two substrates are arranged substantially in parallel having a predetermined gap therebetween, and the amount of light permeating the substrates is controlled by the intensity of the electric field applied to the liquid crystal material. Because of the many advantages of the TFT-LCD—low power consumption, thin profile and low weight, high resolution and others—the CRT, which is presently the most widely used display configuration, is being replaced by this flat panel display technology in many areas.

FIG. 1 shows a schematic view of a general TFT-LCD. The TFT-LCD includes an LCD panel 10, a gate driver 20, a data driver 30, and a timing generator 40. A plurality of gate lines G are formed on the LCD panel 10, and a plurality of data lines D are formed insulated from and crossing the gate lines G. A TFT 12 is formed in each pixel defined by the crossing of gate lines G and the data lines D. A gate electrode, source electrode, and drain electrode of each TFT 12 are connected respectively to one of the gate lines G, one of the data lines D, and a pixel electrode (not shown). Liquid crystal material is injected between a substrate (TFT substrate) on which the above elements are formed and a substrate (common electrode substrate) on which are formed common electrodes. The two substrates and the liquid crystal material injected between the two substrates act as a capacitor Cl.

The gate driver 20 applies a gate ON/OFF voltage to the gate lines G to turn the TFTs ON or OFF. The gate ON voltage is applied sequentially to one of the gate lines G such that the TFTs connected to the gate lines G are turned ON in sequence. Further, the data driver 30 applies a gray voltage to the data lines D. Finally, the timing generator 40 receives from a graphic controller (not shown) a vertical synchronization signal Vsync, a horizontal synchronization signal Hsync, a clock signal CLK, and a data signal DATA, and outputs a variety of timing control signals to the gate driver 20 and the data driver 30.

The operation of the TFT-LCD structured as in the above will be described hereinafter.

The gate ON voltage is applied to the gate electrodes via the gate lines G such that the TFTs 12 are turned ON, after which the gray voltages, representing image signals, are applied to the source electrodes through the data lines D and then transmitted to the drain electrodes. As a result, the gray voltages are transmitted to the pixel electrodes, and electric fields are formed by a potential difference between the pixel electrodes and the common electrodes. An intensity of the electric field is controlled by the magnitude of the gray voltage, and the amount of light permeating the substrates is determined by this level of the electric field intensity.

As the size of the conventional TFT-LCD increases, the increased parasitic capacitance of the data lines prevents the gray voltages from sufficiently charged to the data lines. As a result, an inadequate gray voltage is transmitted to each of the pixels. To improve charge characteristics of the data lines, a method of precharging each data line to a predetermined voltage level is used in a conventional TFT-LCD.

In the conventional TFT-LCD, image data corresponding to an (n)th horizontal line (pixel line) are sampled and the sampled data are written on each of the data lines. When writing of the sampled (n)th data, image data corresponding to an (n+1)th horizontal line are sampled. Data lines are precharged in an interval between data writing times (data enable intervals) of the (n)th horizontal line and the (n+1)th horizontal line.

U.S. Pat. Nos. 5,426,447 and 5,510,807 disclose the above data line precharging methods. In these inventions, the data lines are precharged in an interval (i.e. invalid data interval) between the data enable interval of the (n)th horizontal line and the data enable interval of the (n+1)th horizontal line as described above. Also, a block addressing method is used in these inventions. In block addressing, a single pixel line is divided into blocks, each having many data lines, and each block is sequentially selected. For example, in a display device having 640 data lines, after the data lines are divided into 10 blocks each having 64 data lines, each block is selected within a single horizontal interval such that image data are written to the data lines within the selected block.

FIG. 2 shows a diagram used to describe the conventional precharging method in which precharging is performed in the interval (i.e., the invalid data interval) between the data enable intervals of the (n)th horizontal line and the (n+1)th horizontal line. A valid data interval shown in FIG. 2 refers to the interval during which sampled image data is written on one horizontal line. In the conventional precharging method, precharging is performed only between valid data intervals (data enable intervals). That is, precharging is performed during invalid data intervals P1 and P2. Accordingly, if the invalid data intervals P1 and P2 are not long enough, various problems may result.

Namely, in the conventional precharging method, since all the data lines must be precharged to a desired voltage level within the relatively short precharging interval, an extremely large amount of current is necessary for precharging, giving much stress to a current driving capability of the system. For example, in a color XGA display having 1024×3 (R,G,B) data lines, if a parasitic capacitance of each data line is 80 pF, a large capacitance of 1024×3×80 pF=245.7 nF must be charged within a maximum allowable time of approximately 4.6 $\mu$sec to one horizontal line. Further, in the conventional precharging method, since precharging is performed in the intervals (invalid data intervals) between adjacent data enable intervals, if adjacent data intervals overlap without invalid data intervals, data lines can not be precharged.

On the other hand, a method is used in larger TFT-LCDs in which after gate blocks are selected, gate ON signals are applied to each gate line within the selected block. Such a TFT-LCD structure is disclosed in U.S. Pat. Nos. 5,028,916, 4,714,921, and 5,426,447. However, these inventions require many bus lines in a gate driver structure, increasing a circuit area of the gate drivers and resulting in line open defects during the manufacture of the gate driver.

SUMMARY OF THE INVENTION

The present invention has been made in an effort to solve the above problems.

It is an object of the present invention to provide a display device, and an apparatus and a method for driving the display device that reduce a current level needed for precharging, allowing a high degree of margin for a precharging signal generator design, and making it possible to be applied to systems having a limited valid data interval.

It is another object of the present invention to provide a display device, and an apparatus and a method for driving the display device that reduce the number of required bus lines and a circuit area of a gate driver, thereby preventing line defects.

To achieve the above objects, the present invention provides a display device (e.g., a liquid crystal display), and an apparatus and a method for driving the display device. The LCD includes an LCD panel comprising a plurality of gate lines, a plurality of data lines insulated from and intersecting the gate lines, and a plurality of TFTs each having a gate electrode connected to one of the gate lines and a source electrode connected to one of the data lines; a gate driver for sequentially supplying gate drive signals to the gate lines to turn the TFTs ON; and a data driver that divides the data lines into an X-number of blocks, each block having a predetermined number of data lines, and that applies image signals to the data lines in an (n)th block and applies precharging voltages to the data lines in an (n+j)th block.

According to a feature of the present invention, the data driver includes a block select signal generator for generating block select signals to select one of the blocks; an image signal processor that generates the image signals for applying to the data lines in a selected block; a precharging signal generator that generates the precharging voltages for applying to the data lines in the selected block; an X-number of image signal select switch blocks for switching each of the image signals for application to one of the blocks; and an X-number of precharging select switch blocks for switching each of the precharging voltages for application to one of the blocks, wherein an (n)th block select signal simultaneously turns ON an (n)th image signal select switch block and an (n+j)th precharging signal select switch block.

According to another feature of the present invention, the precharging voltages are at a single voltage level.

According to yet another feature of the present invention, the precharging voltages have a center value between a maximum and a minimum value of the image signals.

According to still yet another feature of the present invention, an (n)th image signal select switch block among the X-number of select switch blocks comprises at least a Y-number of first MOS transistors having sources to which the image signals are applied, drains connected to the data lines, and gates to which the (n)th block select signal is applied; and wherein an (n)th precharging signal select switch block among the X-number of select switch blocks comprises at least a Y-number of second MOS transistors having sources to which the precharging voltages are applied, drains connected to the data lines, and gates to which an (n−j)th block select signal is applied.

According to still yet another feature of the present invention, the first and second MOS transistors are TFTs fabricated on a substrate of the LCD.

According to still yet another feature of the present invention, the TFTs are made of poly-crystal silicon or single-crystal silicon.

According to still yet another feature of the present invention, the precharging voltages each include a first precharging signal and a second precharging signal having a first voltage level and a second voltage level, respectively.

According to still yet another feature of the present invention, the first precharging signal has a predetermined value between a maximum and a center value of the image signals, and the second precharging signal has a predetermined value between a minimum value and a center value of the image signals.

According to still yet another feature of the present invention, an (n)th image signal select switch block among the X-number of select switch blocks comprises at least a Y-number of first MOS transistors having sources to which the image signals are applied, drains connected to the data lines, and gates to which the (n)th block select signal is applied; and wherein an (n)th precharging signal select switch block among the X-number of select switch blocks comprises at least a Y-number of second MOS transistors having sources to which the precharging voltages are applied, drains connected to the Y-number of data lines, and gates to which an (n−j)th block select signal is applied.

According to still yet another feature of the present invention, the first precharging signal is applied to the sources of the second MOS transistors connected to odd data lines, and the second precharging signal is applied to the sources of the second MOS transistors connected to even data lines.

The drive apparatus includes the gate driver and the data driver.

In another aspect, the drive apparatus is applied to a display device including a plurality of scanning lines and a plurality of data lines insulated from and intersecting the scanning lines, wherein the drive apparatus includes a scanning driver for sequentially supplying scanning signals to the scanning lines; and a data driver for dividing the data lines into an X-number of blocks, each block having a predetermined number of data lines, and applying image signals to the data lines in an (n)th block, and applying precharging voltages to the data lines in an (n+j)th block.

The method for driving an LCD includes the steps of sequentially supplying gate drive signals to the gate lines to turn the TFTs ON; and dividing the data lines into an X-number of blocks, each block having a predetermined number of data lines, and applying image signals to the data lines in an (n)th block, and applying precharging voltages to the data lines in an (n+j)th block.

According to a feature of the method, j has a value of 1.

According to another feature of the method, if the image signals are applied to data lines in a last block of an (i)th pixel row, the precharging voltages are, at the same time, applied to data lines in a first block of an (i+1)th pixel row.

According to yet another feature of the method, a first block of an (i)th pixel row uses a separate first block precharging signal received externally.

In another aspect, the LCD includes an LCD panel including an R-number of gate lines, a plurality of data lines insulated from and intersecting the gate lines, and a plurality of TFTs each having a gate electrode connected to one of the gate lines and a source electrode connected to one of the data lines; a data driver for applying image signals to the data lines; and a gate driver for sequentially supplying gate drive signals to the gate lines to turn the TFTs ON, wherein the R-number of gate lines are divided into an X-number of blocks having a minimum Y-number of gate lines, and the X-number of blocks are divided into a minimum Z-number of groups connected to the gate driver.

The gate driver includes a group select signal generator for generating group select signals to select one of the Z-number of groups; a block select signal generator for generating block select signals to select one of the X-number of blocks; a sub-signal generator for generating sub-signals to select one of the Y-number of gate lines; and a gate array for receiving the group select signals, the block select signals, and the sub-signals, and outputting the gate drive signals.

According to another feature of the aspect, a gate array performs an AND operation of the group select signals, the block select signals, and the sub-signals.

According to yet another feature of the aspect, the gate array comprises a plurality of AND gates including input terminals connected to each of the group select signals, the block select signals, and the sub-signals, and output terminals each connected to one of the gate lines.

According to still yet another feature of the aspect, the gate array includes a plurality of NAND gates into which the group select signals, the block select signals, and the sub-signals are input; and a plurality of inverters for inverting output signals of the NAND gates and outputting the inverted signals to the gate lines.

According to still yet another feature of the aspect, the inverters include a first, second and third inverter connected to the NAND gates, of which a current drive capacity increases from the first to the third inverter.

In another aspect, the drive apparatus is applied to a display device including an R-number of scanning lines transmitting scanning signals, and a plurality of data lines transmitting image signals, the drive apparatus including a data driver for applying image signals to data lines; and a scanning driver for sequentially supplying the scanning signals to the scanning lines such that the image signals applied to the data lines are displayed, wherein the R-number of scanning lines are divided into a plurality of blocks having a maximum Y-number of the scanning lines, and the blocks are divided into a Z-number of groups having a maximum X-number of blocks.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIGS. 8*a*–8*e* are graphs used to describe effects of precharging according to the second preferred embodiment of the present invention;

DETAILED DESCRIPTION OF THE PREFERRED EMBODIMENTS

Preferred embodiments of the present invention will now be described in detail with reference to the accompanying drawings.

Figure 1:
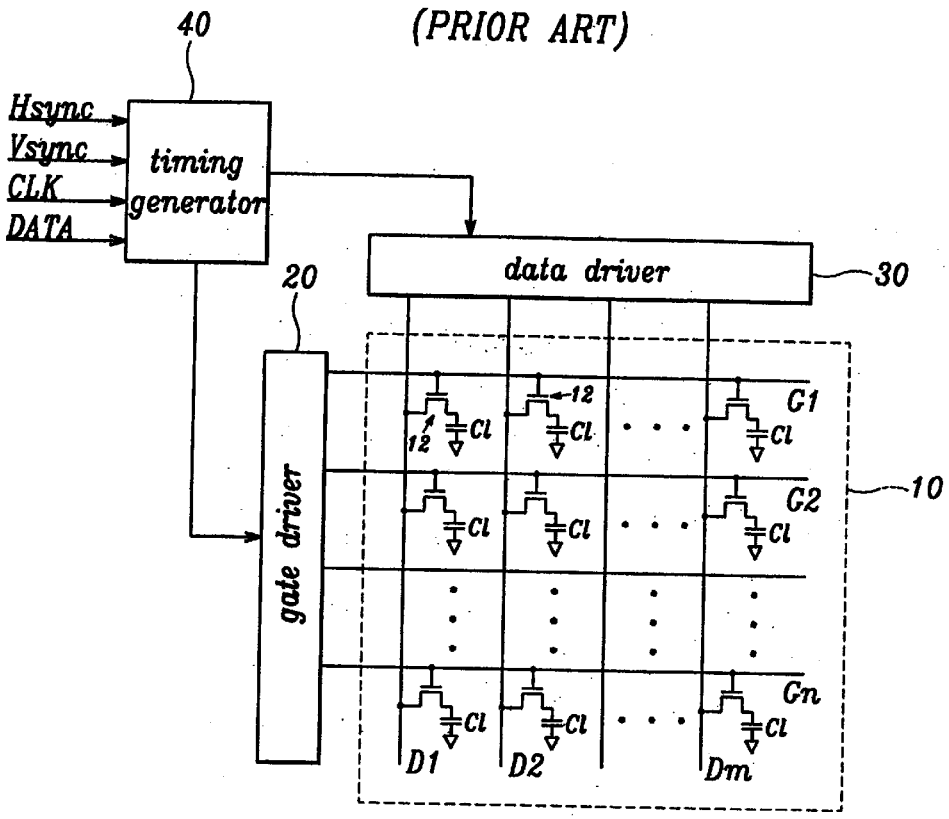
FIG. 1 is a schematic view of the conventional TFT-LCD.
Figure 2:
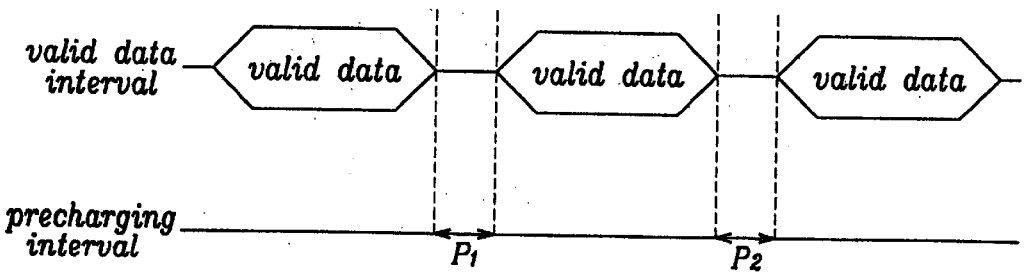
FIG. 2 shows a diagram used to describe a conventional precharging method in which precharging is performed in an interval between data enable intervals of an (n)th horizontal line and an (n+1)th horizontal line.
Figure 3:
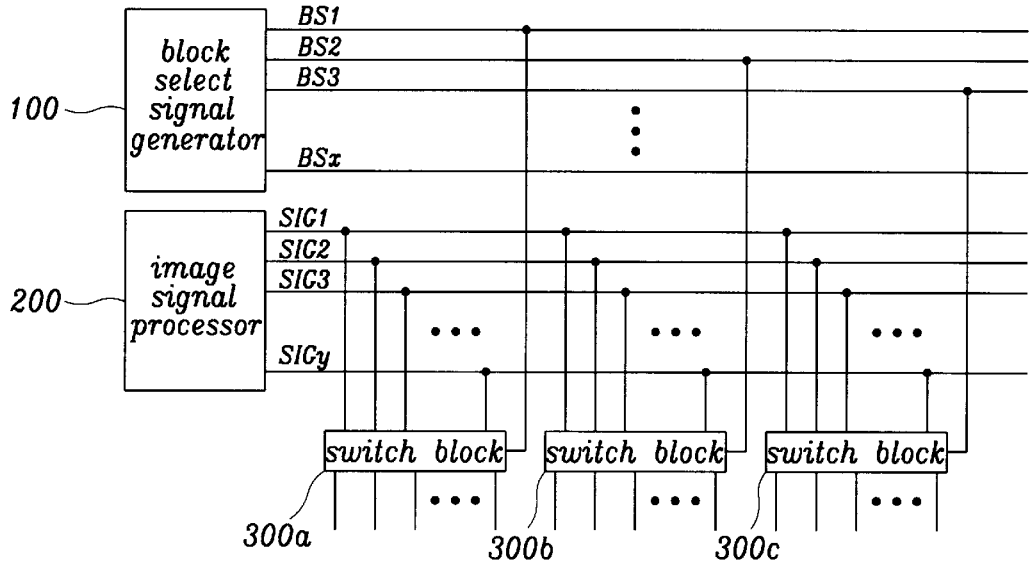
FIG. 3 is a schematic view of a data driver used for block addressing.

FIG. 3 shows a schematic view of a data driver used for block addressing. The data driver includes a block select signal generator 100, an image signal processor 200, and switch blocks 300. All data lines are divided into an x-number of blocks, and each block has a y-number of data lines.

The block select signal generator 100 outputs block select signals BS for selecting one of the blocks. Here, the block select signal BS1 corresponds to a first block and is applied to the switch block 300*a*, the block select signal BS2 corresponds to a second block and is applied to the switch block 300*b*, and the block select signal BS3 corresponds to a third block and is applied to the switch block 300*c*. This pattern is repeated for all the block select signals BS and the x-number of switch blocks 300. The switch block 300 receiving the block select signal BS of a high (or low) state is applied is turned ON. At this time, the block select signal generator 100 sequentially selects an x-number of blocks.

The image signal processor 200 writes image data SIG to the selected block. That is, the image data SIG output from the image signal processor 200 are written on data lines of the LCD panel through the switch blocks 300 that are turned ON by the block select signal generator 100.

In the block addressing method, if R is a total number of the data lines, the number of the blocks X and the number of the data lines in each block Y must satisfy the following equation.

$$X*Y \geqq R \qquad \text{[Equation 1]}$$

For example, in an XGA display panel having 1024×3 (3072) data lines, a possible design may comprise 16 blocks each having 192 data lines. In this case, X*Y is exactly 3072, with no leftover data lines. Further, with the number of the data lines in each block Y set at 220 and the number of blocks X set at 14, Equation 1 can again be satisfied, but either the first or the last block must have fewer than 220 data lines.

Figure 4:
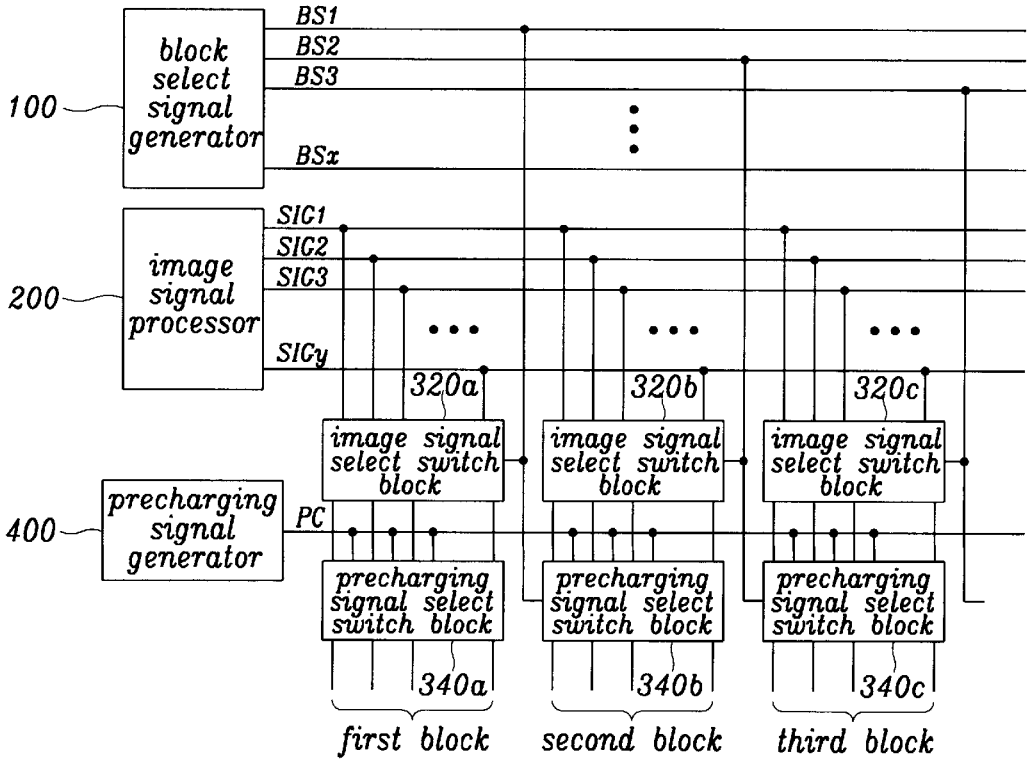
FIG. 4 is a schematic view of a data driver according to a preferred embodiment of the present invention.

A data driver according to a preferred embodiment of the present invention will be described hereinafter with reference to FIG. 4. The data driver includes a block select signal generator 100, an image signal processor 200, a precharging signal generator 400, image signal select switch blocks 320, and precharging signal select switch blocks 340.

The block select signal generator 100 outputs block select signals BS to the image signal select switch blocks 320 and the precharging select switch blocks 340. At this time, an (n)th block select signal BS is input to an (n)th image signal select switch block 320 and an (n+1)th precharging select switch block 340. So, for example, the block select signal BS1 is output to the image signal select switch block 320*a* and the precharging select switch block 340*b*.

The image signal processor 200 applies image signals SIG to the selected image signal select switch blocks 320 . That is, the image signals SIG output from the image signal processor 200 passes through the image signal select switch blocks 320, which are turned ON by the block select signals BS of the block select signal generator 100, to be applied to data lines of a LCD panel.

The precharging signal generator 400 applies precharging signals PC, having a predetermined voltage level, to the precharging signal select switch blocks 340. The precharging signals PC pass through the precharging signal select switch blocks 340, turned ON by the block select signals BS of the block select signal generator 100, to be applied to the data lines of the LCD panel.

In the above described data driver, if a signal to select an (n)th block is applied, the signal is transmitted to an (n)th image signal select switch block 320 to which a Y-number of image signal lines are connected and also to an (n+1)th precharging signal select switch block 340 to which precharging lines are connected to turn these switch blocks 320 and 340 ON. As a result, the image signals SIG are transmitted to the data lines of the LCD panel connected to the (n)th image signal select switch block 320, and the precharging signals PC are transmitted to the data lines of the LCD panel connected to the (n+1)th precharging signal select switch block 340 to precharge (or pre-discharge) these data lines connected to the (n+1)th precharging signal select switch block 340 to a predetermined voltage level. At this time, the predetermined voltage level to which the data lines are precharged (or pre-discharged) can be a level corresponding to a median value between the maximum image data and the minimum image data, or to two or more values closest to the image data to be written on the data lines.

As described above, in the data driver of the present invention, if the image signals SIG are transmitted to the data lines of the LCD panel connected to the (n)th image signal select switch block 320, the data lines connected to the (n+1)th precharging signal select switch block 340 are precharged to a predetermined voltage level.

Figure 5:
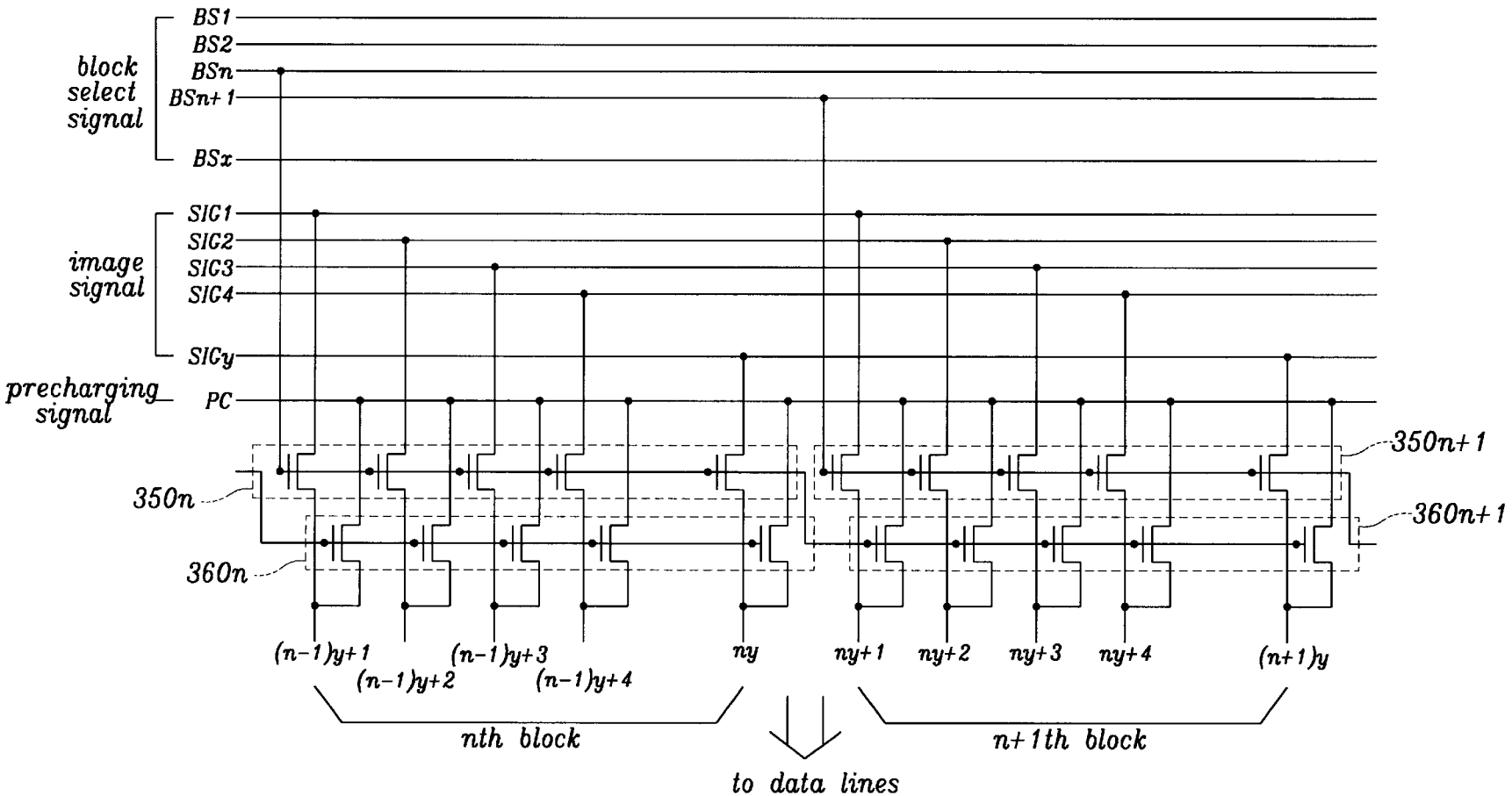
FIG. 5 is a detail view of image signal select switch blocks and precharging signal select switch blocks according to a first preferred embodiment of the present invention.

FIG. 5 shows a detail view of an (n)th image signal select switch block 350*n* and an (n+1)th image signal select switch block 350*n*+1, and an (n)th precharging signal select switch block 360*n* and an (n+1)th precharging signal select switch block 360*n*+1 according to a first preferred embodiment of the present invention. The image signal select switch blocks 350*n* and 350*n*+1, and the precharging signal select switch blocks 360*n* and 360*n*+1 are comprised of a plurality of MOS transistors.

With regard to the MOS transistors of the (n)th image signal select switch block 350*n*, sources of the MOS transistors are respectively connected to each of the image signals SIG1, SIG2, . . . ,SIGy; gates of the MOS transistors are collectively connected to an (n)th block select signal BSn; and drains of the MOS transistors are respectively connected to each of the data lines of the LCD panel. Regarding the MOS transistors of the (n+1)th precharging signal select switch block 360*n*+1, sources of the MOS transistors are collectively connected to the precharging signal PC; gates of the MOS transistors are collectively connected to the (n)th block select signal BSn; and drains of the MOS transistors are respectively connected to each of the data lines of the LCD panel.

If the (n)th block select signal BSn becomes high, the transistors of both the (n)th image signal select switch block 350*n* and the (n+1)th precharging signal select switch block 360*n*+1 are turned ON. Accordingly, the image signals SIG1, SIG2, . . . ,SIGY are transmitted to the data lines connected to the drains of the transistors of the (n)th image signal select switch block 350*n*, and the precharging signal PC is transmitted to the data lines connected to the drains of the transistors of the (n+1)th precharging signal select switch block 360*n*+1.

Effects of precharging (or pre-discharging) according to the first preferred embodiment of the present invention will be described hereinafter with reference to FIGS. 6*a*–6*d*.

Figure 6A:
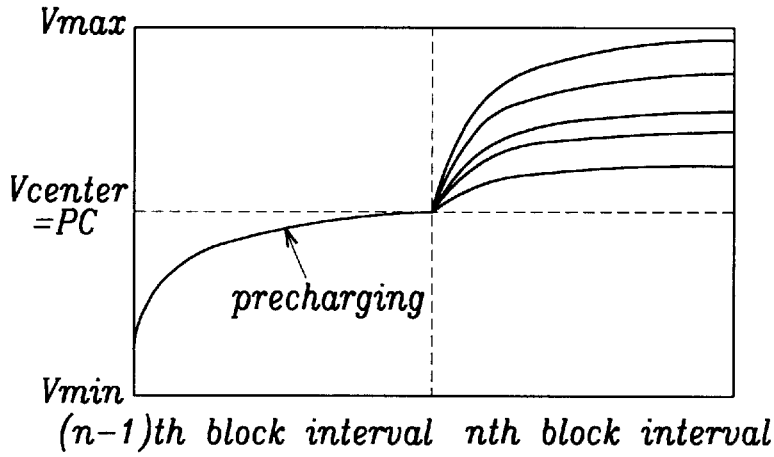
FIGS. 6*a*–6*d* are graphs used to describe effects of precharging according to the first preferred embodiment of the present invention.
Figure 6B:
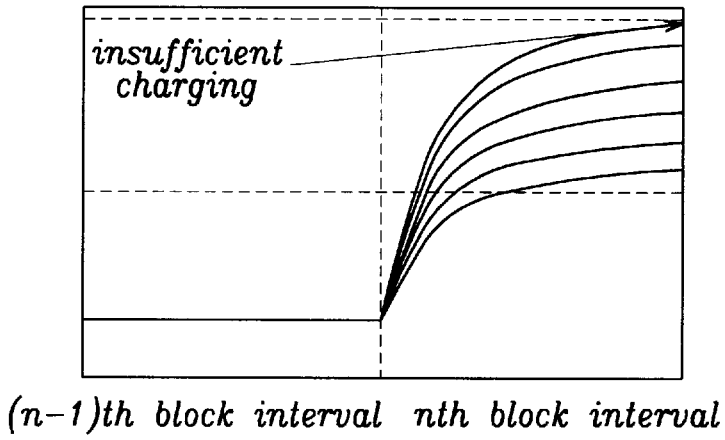
Figure 6C:
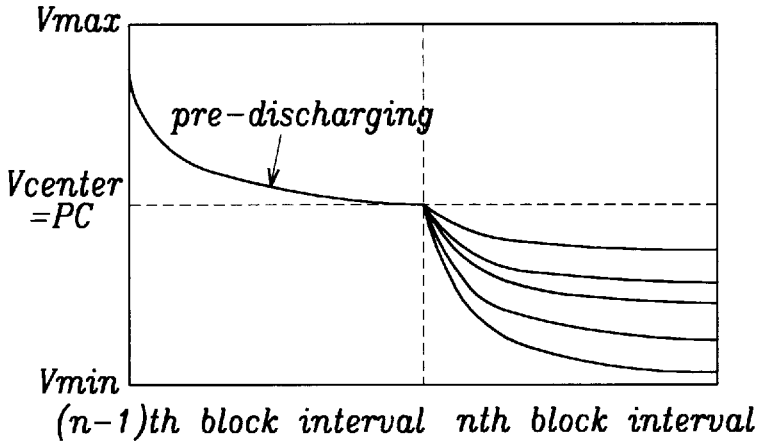
Figure 6D:
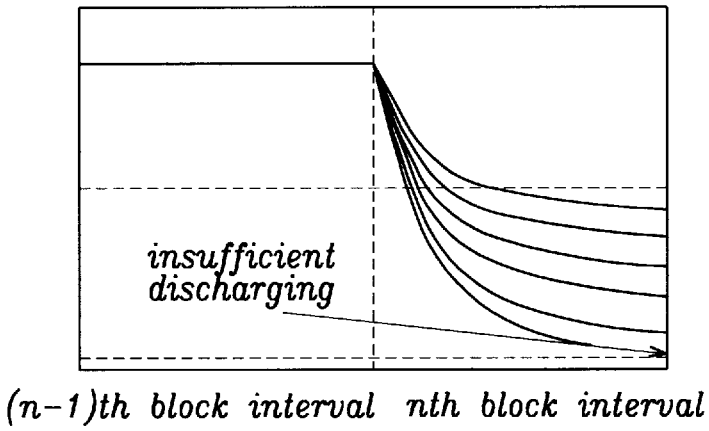

FIGS. 6*a* and 6*c* show the amount of change in the image signals SIG applied to the data lines during an (n)th block interval when the precharging/pre-discharging is performed at a center value Vcenter of a maximum value Vmax and a minimum value Vmin of the image signals SIG in an (n−1)th block interval. FIGS. 6*b* and 6*d* show the amount of change in the image signals SIG applied to the data lines during an (n)th block interval when the precharging/pre-discharging is not performed during an (n−1)th block interval. As is shown by these drawings, the level of the resultant image signals SIG can be more fully realized to a desired level when precharging/pre-discharging than without precharging/pre-discharging.

Figure 7:
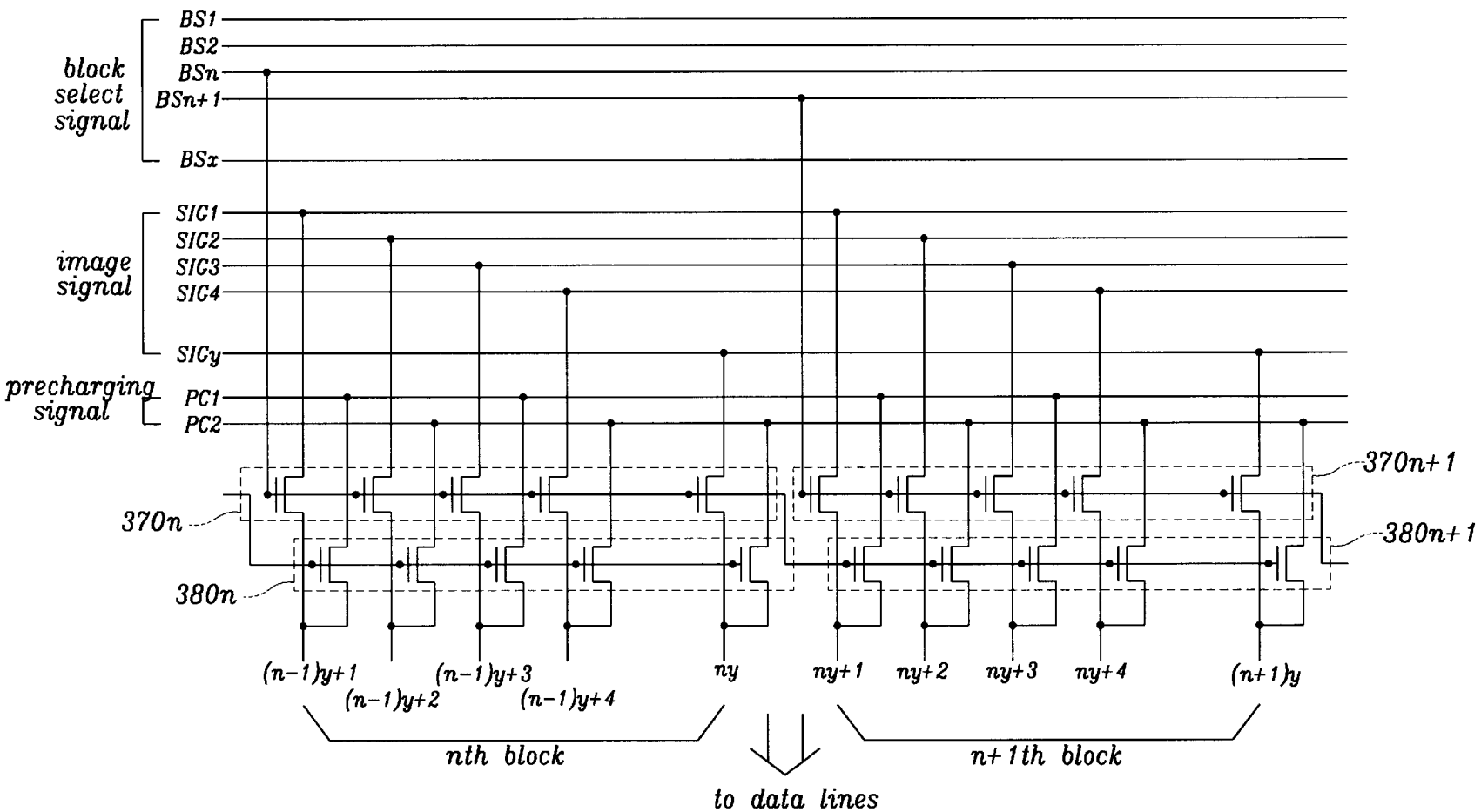
FIG. 7 is a detail view of image signal select switch blocks and precharging signal select switch blocks according to a second preferred embodiment of the present invention.

FIG. 7 shows a detail view of an (n)th image signal select switch block 370*n* and an (n+1)th image signal select switch block 370*n*+1, and an (n)th precharging signal select switch block 380*n* and an (n+1)th precharging signal select switch block 380*n*+1 according to a second preferred embodiment of the present invention. The image signal select switch blocks 370*n* and 370*n*+1, and the precharging signal select switch blocks 380*n* and 380*n*+1 are comprised of a plurality of MOS transistors.

With regard to the MOS transistors of the (n)th image signal select switch block 370*n*, sources of the MOS transistors are respectively connected to each of the image signals SIG1, SIG2, . . . ,SIGy; gates of the MOS transistors are collectively connected to an (n)th block select signal BSn; and drains of the MOS transistors are respectively connected to each of the data lines of the LCD panel. Regarding the MOS transistors of the (n+1)th precharging signal select switch block 380*n*+1, sources of odd-number MOS transistors are collectively connected to a first precharging signal PC1 while sources of even-number MOS transistors are collectively connected to a second precharging signal PC2. Further, gates of the MOS transistors of the (n+1)th precharging signal select switch block 380*n*+1 are collectively connected to the (n)th block select signal BSn, and drains of the MOS transistors are respectively connected to each of the data lines of the LCD panel.

In the above, it is preferable that the first precharging signal PC1 has a value between a maximum value Vmax and a center value Vcenter of the image signals SIG (hereinafter referred to as a "positive value"), and the second precharging signal PC2 has a value between a minimum value Vmin and the center value Vcenter of the image signals SIG (hereinafter referred to as a "negative value"). The values of the first and second precharging signals PC1 and PC2 change from a positive to a negative value in units of frames.

If the (n)th block select signal BSn is controlled to a high state, the transistors of both the (n)th image signal select switch block 370*n* and the (n+1)th precharging signal select switch block 380*n*+1 are turned ON. Accordingly, the image signals SIG1, SIG2, . . . SIGY are transmitted to the data lines connected to the drains of the transistors of the (n)th image signal select switch block 370*n*, and the precharging signals PC1 and PC2 are transmitted to the data lines connected to the drains of the transistors of the (n+1)th precharging signal select switch block 380*n*+1.

Effects of precharging (or pre-discharging) according to the second preferred embodiment of the present invention will be described hereinafter with reference to FIGS. 8*a*–8*e*.

Figure 8A:
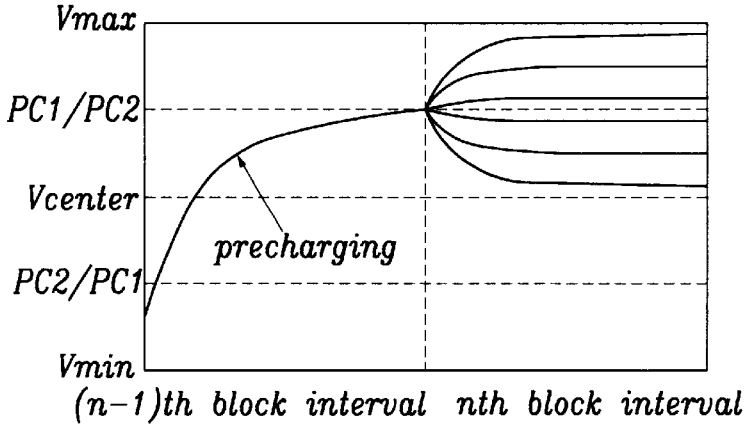
Figure 8B:
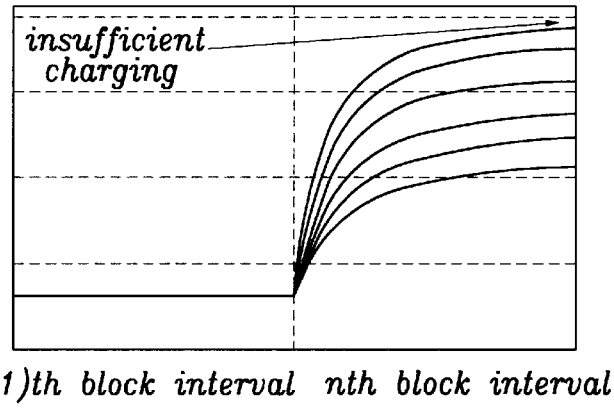
Figure 8C:
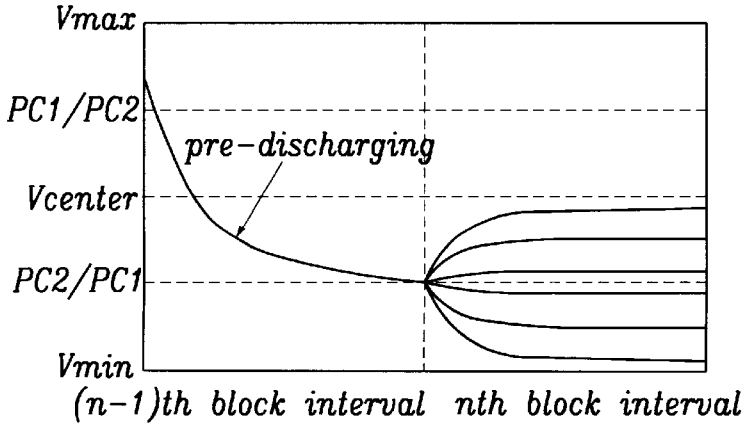

FIGS. 8*a* and 8*c* show the amount of change in the image signals SIG applied to the data lines during an (n)th block interval when precharging/pre-discharging is performed to the first precharging signal PC1 (or the second precharging signal PC2) in an (n−1)th block interval. FIGS. 8*b* and 8*d* show the amount of change in the image signals SIG applied to the data lines during an (n)th block interval when precharging/pre-discharging is not performed during an (n−1)th block interval. Further, FIG. 8*e* shows the amount of change in image signals applied to data lines in the case where precharging/pre-discharging is performed according to the methods disclosed in U.S. Pat. Nos. 5,426,447 and 5,510,807.

In FIG. 8*e*, all the data lines of an LCD panel are precharged in an interval before a first block is selected, and a value of this precharging is maintained until an (n)th block is selected and the image signals are applied to the data lines. However, as described previously, if the interval for precharging is short, a large current must be supplied to the data lines to perform precharging to a desired level.

Accordingly, as is shown by these drawings, the level of the resultant image signals SIG can be more fully realized to a desired level when precharging/pre-discharging the data lines, than without precharging/pre-discharging.

In the first and second embodiments of the present invention, the first block of pixel lines may use a final block select signal of a previous pixel line to perform precharging/pre-discharging, or a separate first block precharging signal may be generated and used.

Figure 9:
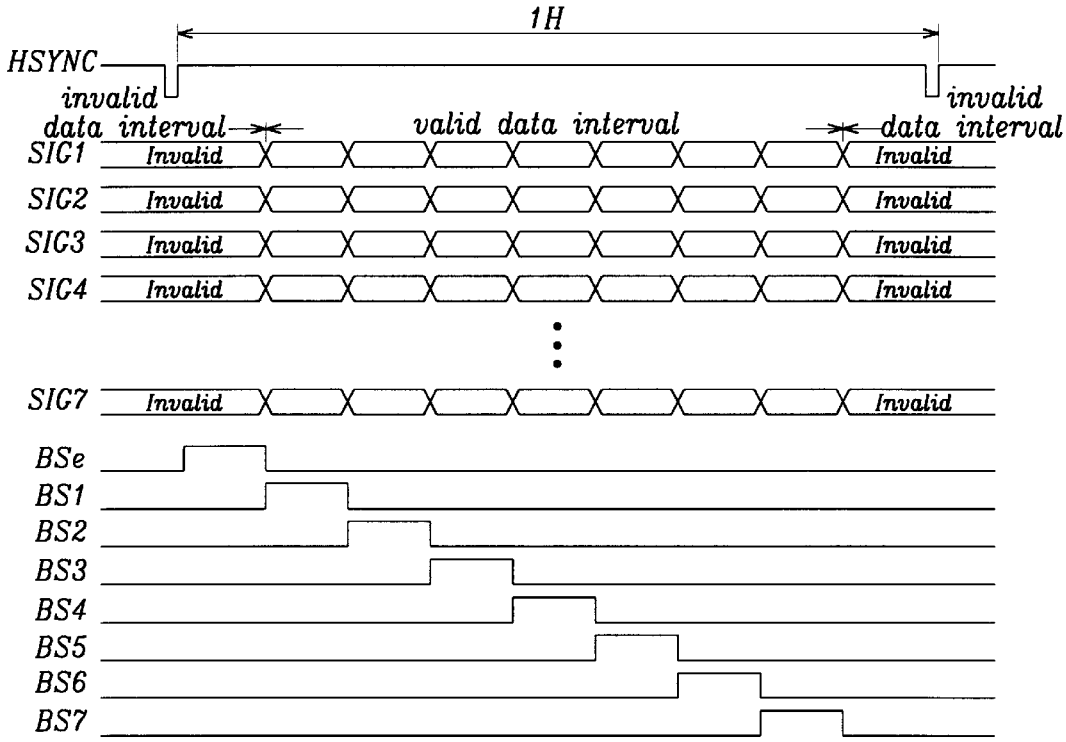
FIG. 9 is a timing chart of a method of separately applying external precharging signals of a first block according to a preferred embodiment of the present invention.

FIG. 9 shows a timing chart of a method of separately applying external precharging signals for a first block according to a preferred embodiment of the present invention. A single interval 1H of a horizontal synchronization signal HSYNC includes invalid data intervals and valid data intervals. Block signals BS1, BS2, BS3, . . . , BS7 respectively select a first block, a second block, a third block, . . . , a seventh block, the blocks applying image signals SIG1, SIG2, SIG3, . . . , SIG7, respectively. The block signals BS, as described above, are applied also to a subsequent block for precharging (or pre-discharging). The block select signals BS1, BS2, BS3, . . . , BS7 are only in a high state in the valid data intervals. A block select signal BSe in FIG. 9 is used to precharge the first block, and is in a high state in the invalid data intervals.

The select switch blocks shown in FIGS. 5 and 7 can be fabricated into a single module (or chip) separated from the LCD panel and then be connected to the data lines of the LCD panel, or can be directly manufactured on the LCD panel substrate using the TFTs. In this case, poly-crystal silicon or single-crystal silicon can be used as the TFTs. Further, in the embodiments of the present invention, described was the example of precharging (or pre-discharging) the data lines connected to the (n+1)th block when the image signals are applied to the (n)th block. However, it is also obvious that data lines connected to an (n+j)th block can be precharged (or pre-discharged). Here, j can be any positive integer such as 1, 2, 3, etc., with the resultant sum being smaller than the total number of blocks. Since the structure and operation of data drivers meeting such requirements can be easily conceived by those in the art to which the present invention pertains, a description and drawings thereof will be omitted herein.

In addition, the first block of the pixel lines may use a (j−1)th previous select signal from the final block of the previous pixel line to perform precharging/pre-discharging, or a separate first block precharging signal can be generated and used.

In the precharging method of the preferred embodiments of the present invention described in the above, since the data lines are precharged a number of times (in each block interval), it is possible to reduce a required maximum current of the system when compared to the conventional method of precharging in the intervals between each horizontal line. For example, in a color XGA display having 3072 data lines, assuming that a parasitic capacitance of each data line is 80 pF, a total load of 245.76 nF (80 pF×3072) must be precharged. However, in preferred embodiments of the present invention, since the data lines are divided into 16 blocks and each block is sequentially precharged, a significantly smaller 15.36 nF load is used for precharging each block.

Figure 10:
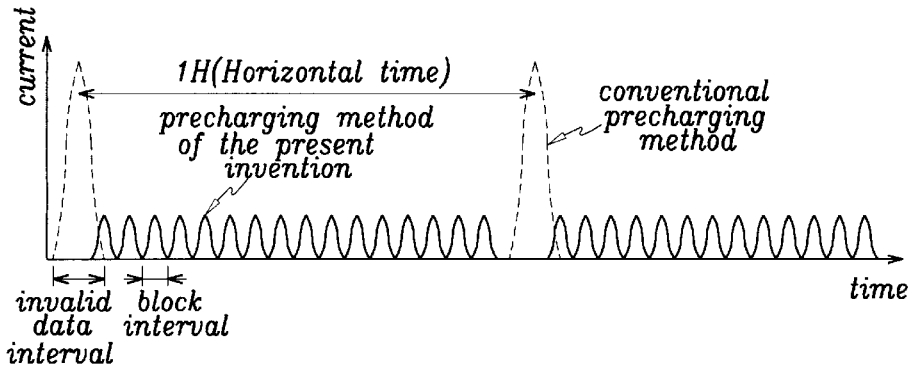
FIG. 10 is a graph comparing current variations in a conventional precharging method and a precharging method of the present invention.

FIG. 10 shows a graph comparing current variations in a conventional precharging method and a precharging method of the present invention. As shown in the drawing, although the total power consumption in the precharging signal generator is the same, a peak current value is smaller in the present invention. Therefore, it can provide lots of freedom in designing the layout of the precharging signal generator. Further, since it is possible to perform precharging also in the valid data intervals, rather than only in the invalid data intervals as in the conventional method, precharging can be effectively performed in systems where the invalid data intervals are short.

Although the present invention was described above in its application to a drive device of a TFT-LCD, it is to be understood that the invention is not limited to this application, and can cover various modifications and equivalent arrangements. For example, the present invention can be applied to all displays where it is advantageous to precharge data lines to which image signals are applied. Further, although the select switch blocks of FIGS. 5 and 7 are realized through MOS transistors, it is also possible to use bipolar transistors, transmission gates, etc.

A gate driver according to a preferred embodiment of the present invention will be described hereinafter with reference to FIG. 11. The gate driver comprises a group select signal generator 510, a block select signal generator 520, a sub-signal generator 530, and a gate array 540. The gate array 540 includes a plurality of AND gates A1, A2, . . . AY . . . , each output terminal of the AND gates being connected to a gate line of the LCD panel. The gate array 540 is divided into a Z-number of gate groups, and each gate group is, in turn, divided into a maximum X-number of gate blocks. Further, each gate block has a maximum Y-number of AND gates.

The group select signal generator 510 outputs group select signals Sg for selecting one of the gate groups of the gate array 540. The group select signals Sg are transmitted to each gate group through a Z-number of bus lines. The block select signal generator 520 outputs block select signals Sb for selecting one of the gate blocks of a gate group. The block select signals Sb are collectively transmitted to the gate blocks of each of the gate groups through an X-number of bus lines. The sub-signal generator 530 outputs sub-signals Ss for selecting one of the AND gates in a gate block. The sub-signals Ss are output to the AND gates of each of the gate blocks through a Y-number of bus lines.

Each AND gate of the gate array 540 receives the group select signals Sg, the block select signals Sb and the sub-signals Ss, and performs an AND operation of these signals. These output signals of the gate array 540 are output to the gate lines of the LCD panel.

Figure 11:
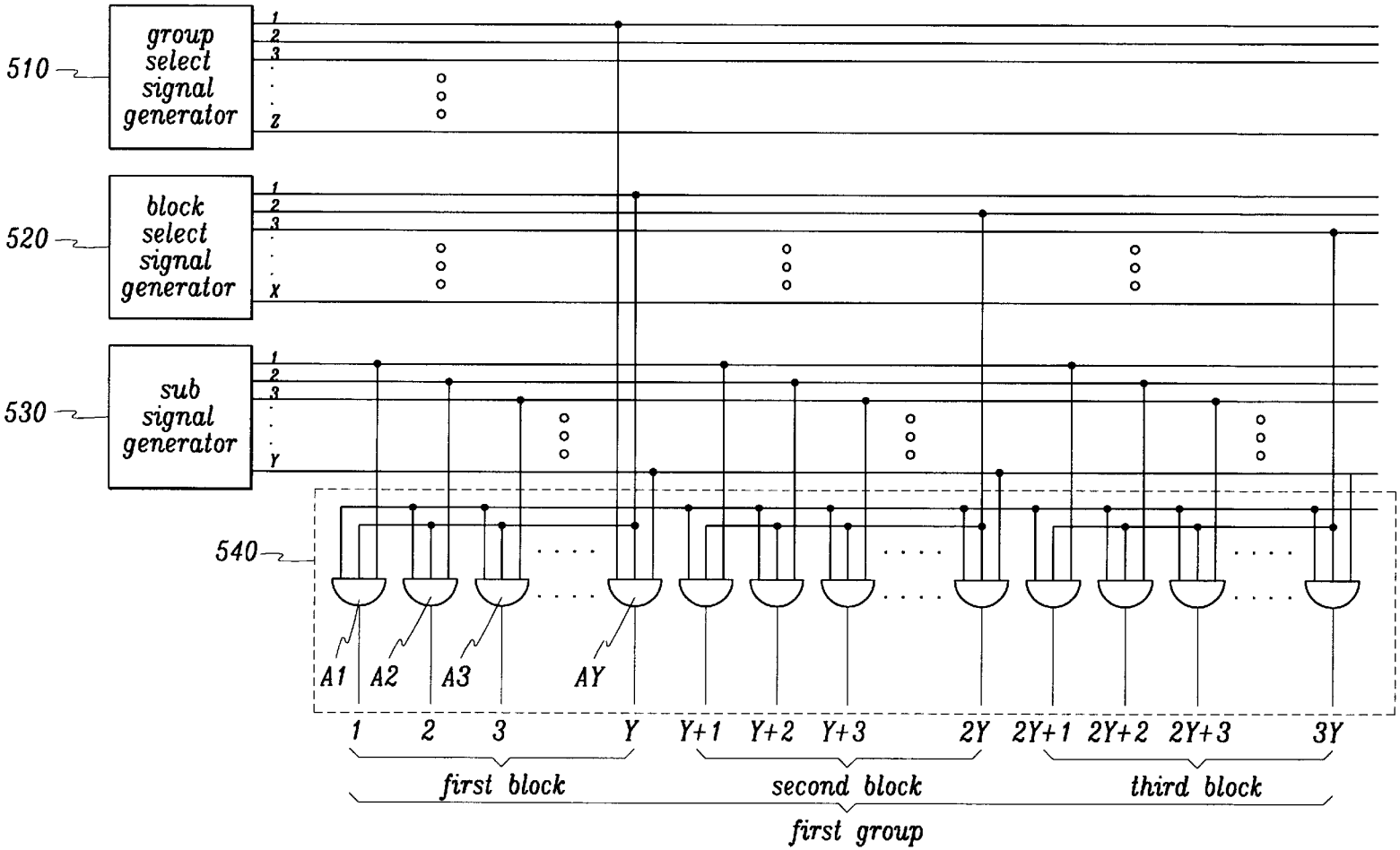
FIG. 11 is a schematic view of a gate driver according to a preferred embodiment of the present invention.
Figure 12:
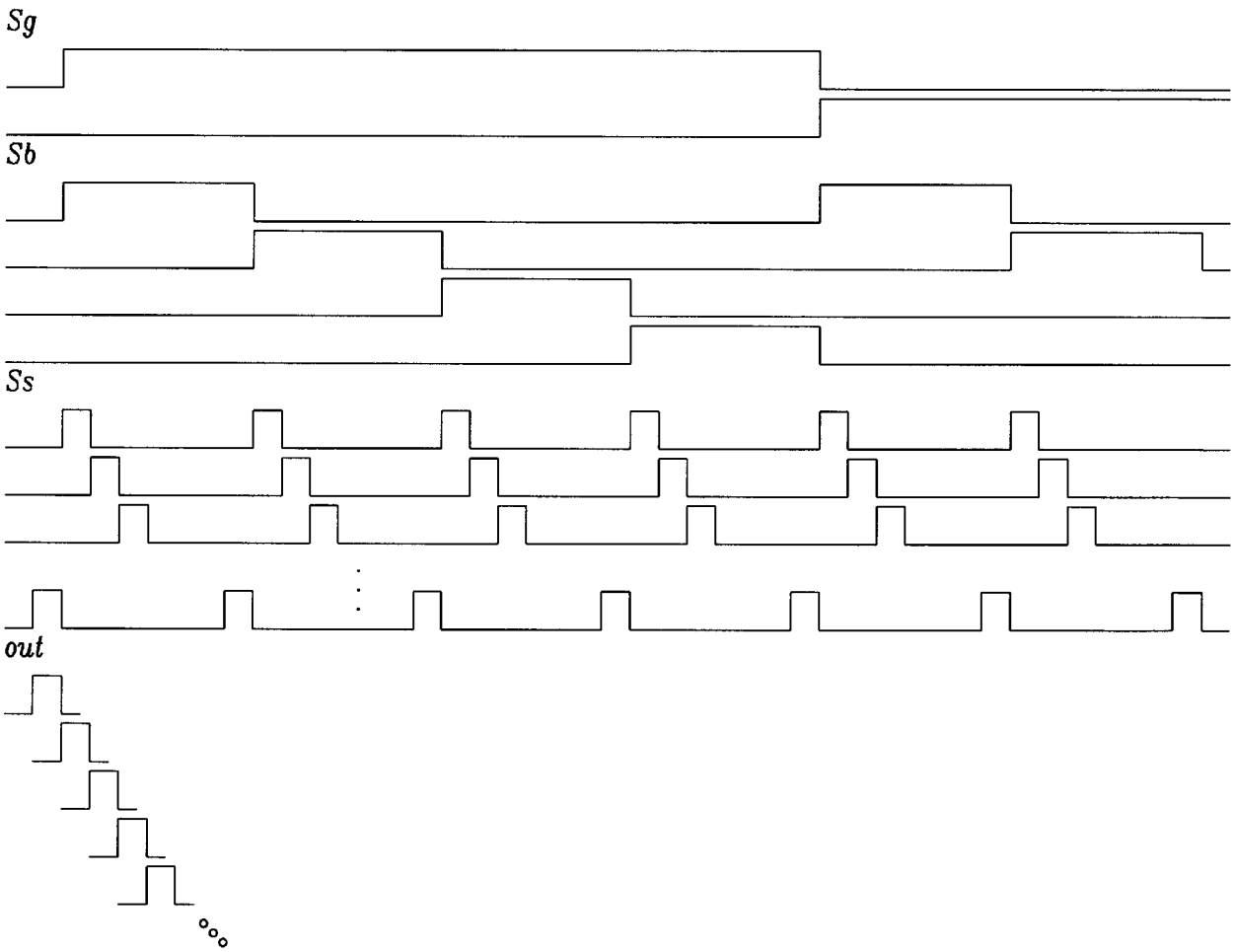
FIG. 12 is a waveform chart of signals of the gate driver shown in FIG. 11.

FIG. 12 shows a waveform chart of the signals of the gate driver shown in FIG. 11. In FIG. 12, there are shown waveforms of the group select signals Sg output by the group select signal generator 510, the block select signals Sb output by the block select signal generator 520, and the sub-signals Ss output by the sub-signal generator 530. Also shown is a waveform of output signals coming out of the gate array 540.

As shown in the drawing, in an interval where one group select signal Sg is in a high state, an X-number (4 in FIG. 12) of the block select signals Sb sequentially changes temporarily into a high state then back to a low state. Also, in an interval where one block select signals Sb is in a high state, a Y-number of the sub-signals Ss sequentially changes temporarily into a high state then back to a low state.

Since the group select signals Sg, the block select signals Sb, and the sub-signals Ss are applied to input terminals of the AND gates of FIG. 11, the output terminals of the AND gates are sequentially controlled to high then low states as shown in FIG. 12. Output signals of the AND gates act as gate drive signals are applied to each of the gate lines of the LCD panel.

In the gate driver of the present invention described above, each of the AND gates of the gate array 540 is connected to one of R gate lines, and the gate lines are divided into a plurality of gate blocks having a maximum Y-number of gate lines and a plurality of the gate blocks are divided into a Z-number of gate groups having a maximum X-number of blocks, satisfying the following relation: $Z \times X \times Y \geqq R$.

For example, in an XGA display having 768 gate lines, all the gate lines are divided into 64 blocks each having 12 gate lines, and the 64 blocks are divided into 8 groups each having 8 blocks. In this case, Z is equal to 8, X is equal to 8, and Y is equal to 12. If the gate driver is structured in this manner, 28 bus lines are required (8+8+12) which is a significantly lower number of bus lines than required in the prior art. Further, in the case of a SXGA display having 1024 gate lines, or R=1024, and where the number of the elements are selected such that $Z \times X \times Y \geqq R$ is satisfied, the number of bus lines can be reduced. At this time, it is preferable that the selection of X, Y and Z is done such that the number of signal transmission lines (i.e., X+Y+Z) is minimized. Here, if the number of all the gate lines R is less than the product of the groups Z, the blocks X and the gate lines Y, the number of blocks (or gate lines) either in the first or last group must be adjusted to be less than the others.

Figure 13:
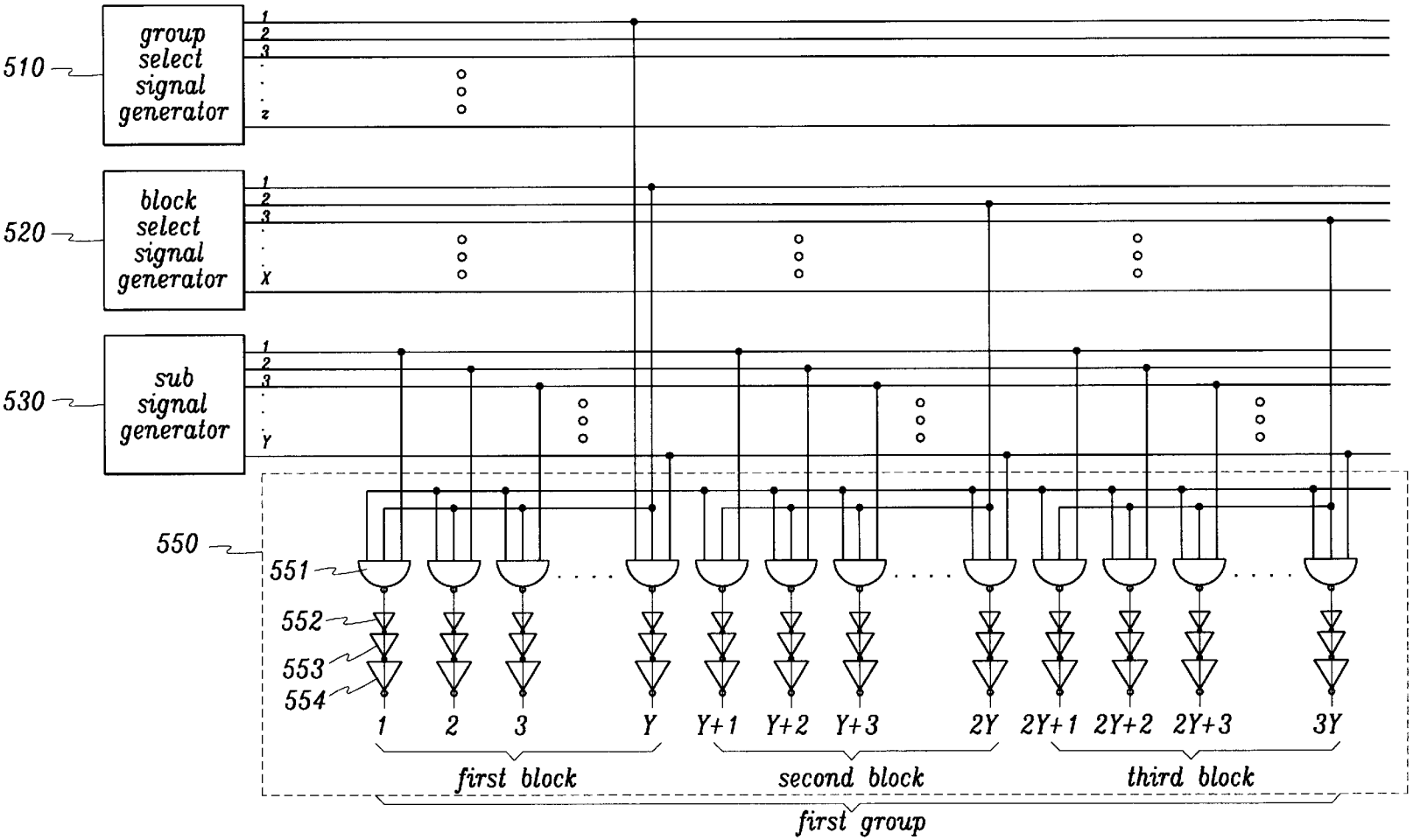
FIG. 13 is a schematic view of a gate driver according to a modified example of the present invention.

It is to be understood that the gate driver is not limited to the structure and operation described above, and can cover various modifications and equivalent arrangements. For example, the AND gates of the gate array 540 shown in FIG. 11 can be replaced by NAND gates 551 of a gate array 550 as shown in FIG. 13. Connected to the NAND gates 551 are inverters 552, 553 and 554. Here, the NAND gates 551 and the inverters 552, 553 and 554 together act as AND gates. The use of the NAND gates 551 combined with the inverters 552, 553 and 554 improves a current drive capability of the gate signals supplied to the gate lines. This is due to the incremental size of the inverters 552, 553 and 554 connected to the NAND gates 551 such that the gate ON signals are able to be effectively transmitted to the gate lines.

The elements of the AND gates, the NAND gates and inverters shown in FIGS. 11 and 13 can be manufactured using NMOS transistors, PMOS transistors, transmission gates, or a mixture thereof.

The gate drivers shown in FIGS. 11 and 13 can be made into a single module (or chip) separated from the LCD panel then connected to the gate lines of the LCD panel, or can be directly manufactured on the LCD panel substrate using the TFTs. At this time, poly-crystal silicon or single-crystal silicon can be used as the TFTs. Further, it is also possible to use TFTs to directly manufacture only the gate arrays on the LCD panel substrate, while the remaining elements are made into an independent module.

In the above, although the gate driver has a structure in which the gate lines were divided into blocks, and the blocks were divided into groups, it is possible to further divide the groups into separate groups. If the groups are again divided, more select signal generators are needed to generate signals for the selection of the separate groups, and the AND gates of the gate array require more input pins.

Further, the gate driver of the present invention was described with its application to a TFT-LCD. However, the gate driver of the present invention can be used with other displays such as PDPs and FEDs in which image signals are applied to vertical lines, and scanning signals are applied to transmit the image signals sequentially to horizontal lines.

In the present invention described above, since the image signals are applied to the data line after precharging is performed in a previous block interval, a maximum current required for precharging is reduced, and precharging in a system having short invalid data intervals can be effectively realized. Further, since the group select signals, block select signals, and sub-signals are applied after the gate lines are divided into blocks and the blocks are divided into groups, the number of bus lines and the area of the circuit can be reduced, and line defects can be minimized.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display (LCD), comprising:

an LCD panel including a plurality of gate lines, a plurality of data lines insulated from and intersecting the gate lines, and a plurality of TFTs each having a gate electrode connected to one of the gate lines and a source electrode connected to one of the data lines;

a gate driver for sequentially supplying gate drive signals to the gate lines to turn the TFTs ON; and a data driver that groups the data lines into an X-number of blocks, each block having a predetermined number of data lines, and applies image signals to the data lines in an (n)th block, and precharging voltages to the data lines in the (n+j)th block, wherein the data driver comprises:

a block select signal generator for generating block select signals to select one of the blocks;

an image signal processor that generates the image signals for the data lines in a selected block;

a precharging signal generator that generates the precharging voltages for the data lines in the selected block;

the X-number of image signal select switch blocks for switching each of the image signals for application to one of the blocks; and the X-number of precharging select switch blocks for switching each of the precharging voltages for application to one of the blocks, wherein an (n)th block select signal generated from the block select signal generator simultaneously activates the (n)th image signal select switch block from an OFF state to an ON state and the (n+j)th precharging signal select switch block from an OFF state to an ON state.

2. The LCD of claim 1, wherein the precharging voltages are at a single voltage level.

3. The LCD of claim 2, wherein the precharging voltages have a center value between a maximum value and a minimum value of the image signals.

4. The LCD of claim 2, wherein an (n)th image signal select switch block among the X-number select switch blocks comprises at least a Y-number of first MOS transistors having sources connected to the image signals, drains connected to the data lines, and gates connected to the (n)th block select signal; and wherein an (n)th precharging signal select switch block among the X-number of select switch blocks comprises at least a Y-number of second MOS transistors having sources connected to the precharging voltages, drains connected to the data lines, and gates connected to the (n−j)th block select signal.

5. The LCD of claim 4, wherein the first and second MOS transistors are TFTs fabricated on a substrate of the LCD.

6. The LCD of claim 5, wherein the TFTs are made of poly-crystal silicon or single-crystal silicon.

7. The LCD of claim 1, wherein the precharging voltages include a first precharging signal and a second precharging signal having a first voltage level and a second voltage level, respectively.

8. The LCD of claim 7, wherein the first precharging signal has a predetermined value between a maximum and a center value of the image signals, and the second precharging signal has a predetermined value between a minimum value and a center value of the image signals.

9. The LCD of claim 8, wherein the (n)th image signal select switch block among the X-number of select switch blocks comprises at least a Y-number of first MOS transistors having sources connected to the image signals, drains connected to the data lines, and gates connected to the (n)th block select signal; and wherein an (n)th precharging signal select switch block among the X-number of select switch blocks comprises at least a Y-number of second MOS transistors having sources connected to the precharging voltages, drains connected to the data lines, and gates connected to the (n−j)th block select signal.

10. The LCD of claim 9, wherein the first precharging signal is applied to the sources of the second MOS transistors connected to odd data lines, and the second precharging signal is applied to the sources of the second MOS transistors connected to even data lines.

11. The LCD of claim 10, wherein the first and second MOS transistors are TFTs fabricated on a substrate of the LCD.

12. The LCD of claim 11, wherein the TFTs are made from poly-crystal silicon or single-crystal silicon.

13. A drive apparatus for a liquid crystal display (LCD), the LCD including a plurality of gate lines, a plurality of data lines insulated from and intersecting the gate lines, matrix-type pixels defined by the gate lines and the data lines, and a plurality of TFTs each provided in one of the pixels and each having a gate electrode connected to one of the gate lines and a source electrode connected to one of the data lines, comprises:

a gate driver for sequentially supplying gate drive signals to the gate lines to turn the TFTs ON; and a data driver that groups the data lines into an X-number of blocks, each block having a predetermined number of data lines, and applies image signals to the data lines in an (n)th block, and precharging voltages to the data lines in the (n+j)th block, wherein the data driver comprises:

a block select signal generator for generating block select signals to select one of the blocks;

an image signal processor that generates the image signals for the data lines in the selected block;

a precharging signal generator that generates the precharging voltages for the data lines in the selected block;

the X-number of image signal select switch blocks for switching each of the image signals for application to one of the blocks; and the X-number of precharging select switch blocks for switching each of the precharging voltages for application to one of the blocks, wherein the (n)th block select signal generated from the block select signal generator simultaneously activates the (n)th image signal select switch block from an OFF state to an ON state and the (n+j)th precharging signal select switch block from an OFF state to an ON state.

14. The drive apparatus of claim 13, wherein j is 1.

15. The drive apparatus of claim 14, wherein a block select signal applied to a first precharging select switch block for precharging a first block uses a block select signal applied to a last image signal select switch block for applying the image signals to a last block.

16. The drive apparatus of claim 13, wherein a block select signal applied to a first precharging select switch block for precharging a first block uses a separate first block precharging signal.

17. The drive apparatus of claim 16, wherein the first block precharging signal is generated in an invalid data interval of a horizontal synchronous signal interval.

18. The drive apparatus of claim 13, wherein the precharging voltages are at a single voltage level.

19. The drive apparatus of claim 18, wherein the (n)th image signal select switch block among the X-number select switch blocks comprises at least a Y-number of first switches having a first terminal to which the image signals are applied, a second terminal connected to the data lines, and a third terminal to which the (n)th block select signal is applied;

wherein the (n)th precharging signal select switch block among the X-number of select switch blocks comprises at least a Y-number of second switches having a first terminal to which the precharging voltages are applied, a second terminal connected to the data lines, and a third terminal to which the (n−j)th block select signal is applied; and wherein the first and the second switches apply the image signals and the precharging voltages, respectively applied to the first terminal of the first switching element and the first terminal of the second switching element, to the data lines according to the block select signals applied to the third terminals of the first and second switches.

20. The drive apparatus of claim 19, wherein the first and the second switches are MOS transistors having a source to which image signals and precharging voltages are respectively applied, a drain connected to data lines, and a gate to which the block select signals are applied.

21. The drive apparatus of claim 13, wherein the precharging voltages each include a first precharging signal and a second precharging signal having a first voltage level and a second voltage level, respectively.

22. The drive apparatus of claim 21, wherein magnitudes of the first and second precharging signals are changed in units of frames.

23. The drive apparatus of claim 21, wherein the (n)th image signal select switch block among the X-number select switch blocks comprises at least a Y-number of first switches having a first terminal to which the image signals are applied, a second terminal connected to the data lines, and a third terminal to which the (n)th block select signal is applied;

wherein the (n)th precharging signal select switch block among the X-number of select switch blocks comprises at least a Y-number of second switches having a first terminal to which the precharging voltages are applied, a second terminal connected to the data lines, and a third terminal to which the (n−j)th block select signal is applied; and wherein the first and second switches apply the image signals and the precharging voltages, respectively applied to the first terminal of the first switches and the first terminal of the second switches, to the data lines according to the block select signals applied to the third terminals of the first and second switches.

24. The drive apparatus of claim 23, wherein the first and second switches are MOS transistors having a source to which image signals and precharging voltages are respectively applied, a drain connected to the data lines, and a gate to which the block select signals are applied.

25. A drive apparatus for a display device, the display device including a plurality of scanning lines and a plurality of data lines intersecting the scanning lines, comprises: a scanning driver for sequentially supplying scanning signals to the scanning lines; and a data driver that groups the data lines into an X-number of blocks, each block having a predetermined number of data lines, and applies image signals to the data lines in an (n)th block and precharging voltages to the data lines in the (n+j)th block, comprises:

a block select signal generator for generating block select signals to select one of the blocks;

an image signal processor that generates the image signals for the data lines in a selected block;

a precharging signal generator that generates the precharging voltages for application to the data lines in the selected block;

the X-number of image signal select switch blocks for switching each of the image signals for application to one of the blocks; and the X-number of precharging select switch blocks for switching each of the precharging voltages for application to one of the blocks, wherein the (n)th block select signal generated from the block select signal generator simultaneously activates the (n)th image signal select switch block from an OFF state to an ON state and the (n+j)th precharging signal select switch block from an OFF state to an ON state.

26. A method for driving a liquid crystal display (LCD), the LCD including a plurality of gate lines, a plurality of data lines insulated from and intersecting the gate lines, matrix-type pixels defined by the gate lines and the data lines, and a plurality of TFTs each provided in one of the pixels and each having a gate electrode connected to one of the gate lines and a source electrode connected to one of the data lines, a gate driver for applying gate drive signals to the gate lines and a data driver that groups the data lines into an X-number of blocks, each block having a predetermined number of data lines and applies image signals to the data lines in an (n)th block and precharging voltages to the data lines in the (n+j)th block, wherein the method comprises the steps of:

sequentially supplying gate drive signals to the gate lines to turn the TFTs ON; and applying image signals to the data lines in the (n)th block and precharging voltages to the data lines in the (n+j)th block at the same time, wherein a block selection signal for activating the data lines in the (n)th block from an OFF state to an ON state for applying the image signals thereto also simultaneously activates the data lines in the (n+j)th block from the OFF state to the ON state for precharging voltages thereto.

27. The method of claim 26, wherein j is 1.

28. The method of claim 27, wherein if the image signals are applied to data lines in a last block, the precharging voltages are, at the same time, applied to data lines in a first block.

29. The method of claim 26, wherein a first block uses a separate first block precharging signal received externally.

* * * * *